US006897846B2

(12) United States Patent
Youn

(10) Patent No.: US 6,897,846 B2
(45) Date of Patent: May 24, 2005

(54) CIRCUIT AND METHOD OF DRIVING LIQUID CRYSTAL DISPLAY

(75) Inventor: Sang Young Youn, Incheon-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 374 days.

(21) Appl. No.: 10/029,176

(22) Filed: Dec. 28, 2001

(65) Prior Publication Data

US 2002/0084971 A1 Jul. 4, 2002

(30) Foreign Application Priority Data

Dec. 29, 2000 (KR) ..... 2000-85390

(51) Int. Cl.[7] ..... G09G 3/36
(52) U.S. Cl. ..... 345/99; 345/100
(58) Field of Search ..... 345/87, 94, 98, 345/99, 100, 90, 92, 213, 211, 212

(56) References Cited

U.S. PATENT DOCUMENTS 4,890,101 A * 12/1989 Carlson ..... 345/55
5,206,632 A * 4/1993 Dupont et al. ..... 345/92
5,400,050 A * 3/1995 Matsumoto et al. ..... 345/100
5,801,673 A * 9/1998 Shimada et al. ..... 345/100

* cited by examiner

*Primary Examiner*—Kent Chang
(74) *Attorney, Agent, or Firm*—Morgan Lewis & Bockius LLP

(57) ABSTRACT

A liquid crystal display panel driving circuit includes a plurality of data signal lines, a plurality of data lines, a plurality of data switches, each data switch connecting at least one data signal line to the plurality of data lines, a plurality of pixels, a plurality of pixel switches connecting a data signal transmitted on each data line to at least one of the pixels, and a plurality of capacitors, each capacitor connected to at least one of the data lines for storing a voltage corresponding to the data signal transmitted by one of the data switches and for transmitting the voltage to one of the pixels.

12 Claims, 5 Drawing Sheets

CIRCUIT AND METHOD OF DRIVING LIQUID CRYSTAL DISPLAY

The present invention claims the benefit of Korean Patent Application No. P2000-85390 filed in Korea on Dec. 29, 2000, which is hereby incorporated by reference.

BACKGROUND OF THE INVENTION

1. Field of the Invention

The present invention relates to a liquid crystal display, and more particularly to a circuit and method of driving a liquid crystal display.

2. Discussion of the Related Art

Generally, liquid crystal display (LCD) devices control light transmittance of liquid crystal cells in accordance with an electrical signal, thereby displaying an image. An active matrix LCD device includes switching devices for each liquid crystal cell, thereby sequentially displaying multiple images to generate a moving image. The active matrix LCD device uses thin film transistors (TFTs) as the switching devices. Since the LCD device has smaller dimensions than a conventional display tube, LCD devices have been widely used in personal computers, notebook computers, office automation equipment such as copy machines, for example, and portable equipment such as cellular phones and pagers, for example.

Presently, polycrystalline silicon panels are used for switching devices and devices for peripheral driving circuits of the active matrix LCD. A polycrystalline silicon driving circuit sequentially applies data voltage from a first data line to a last data line while a gate line is held in an ON-state, thereby decreasing writing time. However, as polycrystalline silicon panels become bigger, the data and gate lines become longer, parasitic capacitance and resistance increase, and the display signal is delayed. Accordingly, to drive the polycrystalline silicon panel, a block driving method is used that divides the data line into several blocks.

FIG. 1 shows a circuit diagram of a display panel driven by a block driving method according to the conventional art.

In FIG. 1, data switches $\phi_1, \phi_2, \ldots \phi_n$ sequentially connect data signals transmitted via signal lines Si−1, Si, Si+1 to data lines DL1, DL2, . . . DLn, and pixel switches P1, P2, . . . Pn transmit the data signals to corresponding pixels (not shown). For example, a data signal is input through the signal line Si, and upon enabling the data switch $N_1$, the pixel switch P1 is turned ON through a first data line DL1 to apply the data signal to a corresponding pixel (not shown). Almost simultaneously, the data switch $\phi_2$ is turned ON, and the data signal Si is transmitted to a second pixel (not shown) through a second data line DL2 and a second pixel switch P2. This switching operation is continuously repeated until the data switch $\phi_n$ is turned ON.

FIG. 2 shows a driving waveform of the block driving method shown in FIG. 1.

In FIG. 2, when transmitting a data signal to a gate line GL, a gate input signal GI is applied to close the pixel switch. Then, the data signal is sequentially applied to first through $n^{th}$ data lines DL1 to DLn Accordingly, a delay is generated between a time $t_1$ when a data signal Si is transmitted by the first data switch $\phi_1$ to the first pixel and a time $t_n$ when the data signal Si is transmitted by the $n^{th}$ data switch $\phi_n$ to the $n^{th}$ pixel, thereby creating a vertical stripe on the display panel. Furthermore, since liquid crystal capacitance increases at low operating temperatures, the vertical stripe is more prominent.

SUMMARY OF THE INVENTION

Accordingly, the present invention is directed to a circuit and method of driving a liquid crystal display that substantially obviates one or more of the problems due to limitations and disadvantages of the related art.

An object of the present invention is to provide a circuit and method for driving a liquid crystal display that includes a capacitor connected between corresponding data lines.

Additional features and advantages of the invention will be set forth in the description which follows, and in part will be apparent from the description, or may be learned by practice of the invention. The objectives and other advantages of the invention will be realized and attained by the structure and method particularly pointed out in the written description and claims hereof as well as the appended drawings.

To achieve these and other advantages and in accordance with the purpose of the present invention, as embodied and broadly described, a liquid crystal display panel driving circuit includes a plurality of data signal lines, a plurality of data lines, a plurality of data switches, each data switch connecting at least one data signal line to the plurality of data lines, a plurality of pixels, a plurality of pixel switches connecting a data signal transmitted on each data line to at least one of the pixels, and a plurality of capacitors, each capacitor connected to at least one of the data lines for storing a voltage corresponding to the data signal transmitted by one of the data switches and for transmitting the voltage to one of the pixels.

In another aspect, a method for driving a liquid crystal display includes sequentially switching a plurality of signal transmission paths between a plurality of signal and data lines to sequentially charge voltages corresponding to a data signal to a plurality of data line capacitors, and simultaneously transmitting each voltage of each data line capacitor to a pixel through at least one of the data lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are intended to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Figure 1:
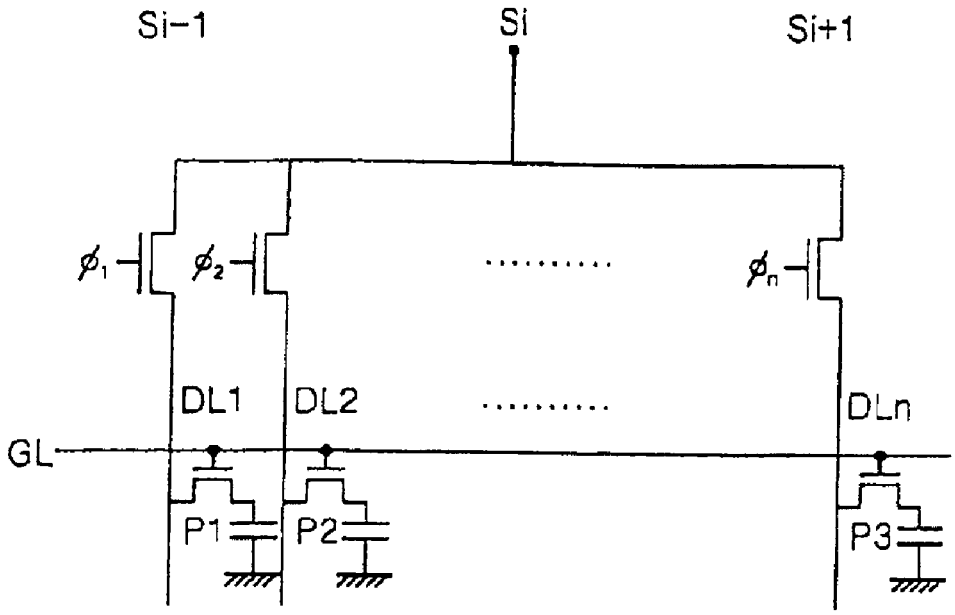
FIG. 1 CONVENTIONAL ART
FIG. 1 is a circuit diagram according to a block driving method of a polycrystalline silicon liquid crystal display according to the conventional art.
Figure 2:
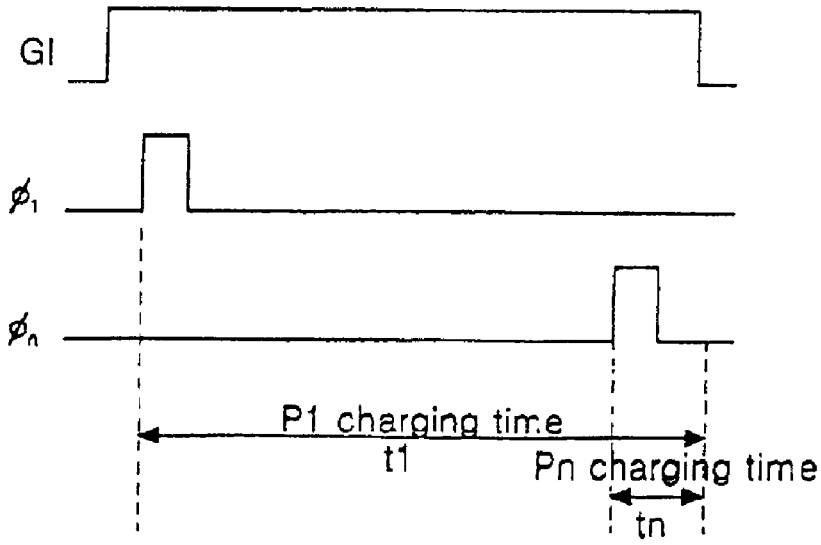
FIG. 2 CONVENTIONAL ART
FIG. 2 is a waveform diagram according to the conventional block driving method illustrated in FIG. 1.
Figure 3:
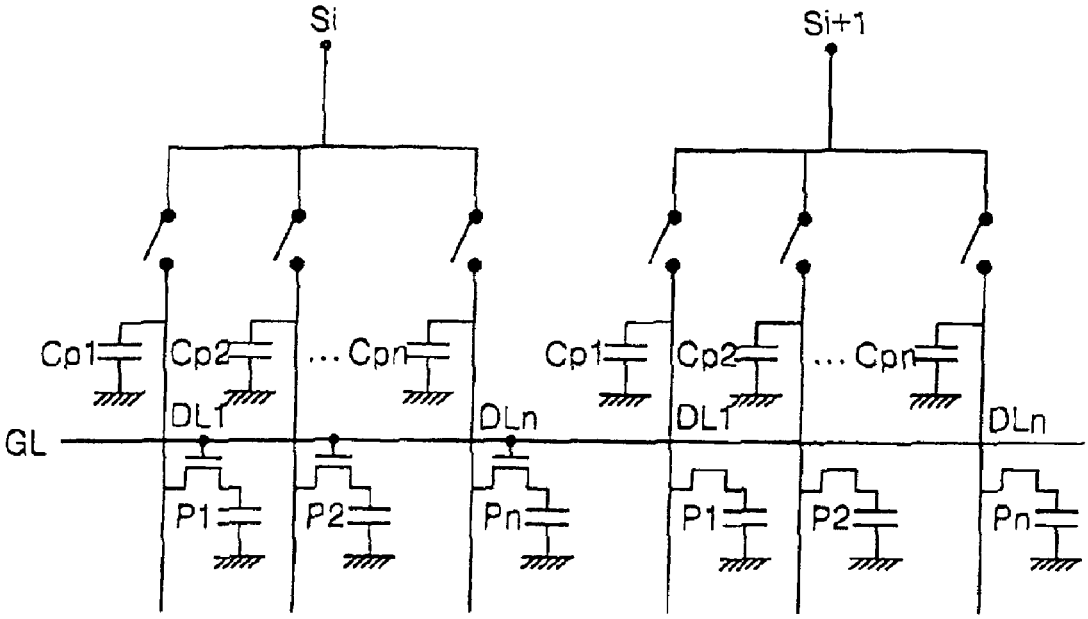
FIG. 3 is a circuit diagram according to an exemplary driving method according to the present invention.

FIG. 3 shows an exemplary circuit diagram of a method of driving a liquid crystal display according to the present invention.

In FIG. 3, parasitic capacitors Cp1, . . . Cpn are individually connected between corresponding data lines DL1, . . . DLn of a display panel and a common voltage Vcom. Alternatively, the data lines DL1, . . . DLn may include additional capacitors connected between each of the data lines DL1, . . . DLn and each corresponding gate line GL, and capacitors connected between the data lines DL1, . . . DLn and corresponding pixels P1, . . . Pn. The additional capacitors are implemented as line capacitors for a block driving method. For example, even though a data switch may be opened after a data signal is applied from a signal line Si to a data line DL, the data signal is continuously maintained by a corresponding data line capacitor. The capacitance of the data line DL may be designed at least one-hundred times as large as the capacitance of a corresponding pixel capacitor, i.e., pixel capacitance.

Figure 4:
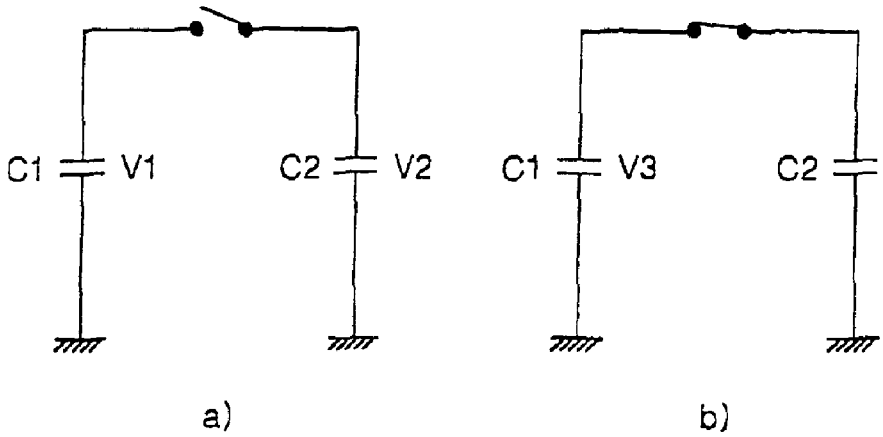
FIGS. 4A and 4B are diagrams showing exemplary charge sharing phenomena according to the present invention.

FIGS. 4A and 4B are circuit diagrams illustrating the charge sharing phenomena.

In FIGS. 4A and 4B, when charging two capacitors C1 and C2 of FIG. 4A to a state of FIG. 4B, the following equation is realized since a voltage V1 is dependent upon the relative capacitance of the two capacitors C1 and C2, if V1=0:

$$V3=C1/((C1+C2)*V1) \quad (1)$$

According to equation 1, when the two capacitors C1 and C2 are suddenly short-circuited, a single capacitor is created with a voltage V3 being stored thereupon. Moreover, if C1 is at least one-hundred times larger than C2, then V1≈V3. In a polycrystalline silicon panel, since a capacitance of the data line capacitor connected to the data line is at least one-hundred times larger than the capacitance of the pixel capacitor, the data signal stored on the data line capacitor is maintained on the pixel capacitor.

Figure 5:
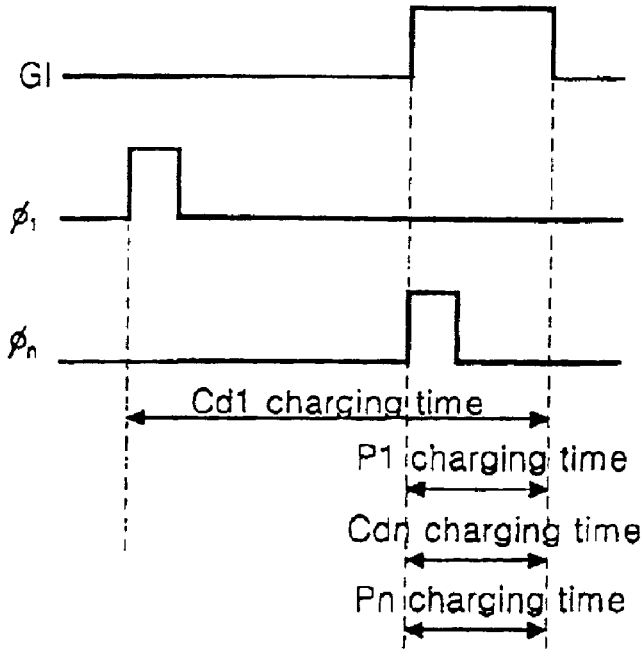
FIG. 5 is a signal waveform diagram according to an exemplary method of driving a liquid crystal display according to the invention.

FIG. 5 illustrates an exemplary gate driving method according to the present invention. In FIG. 5, block applying signals $\phi_1$ through $\phi_{n-1}$ are sequentially applied to charge corresponding data line capacitors Cd1 through Cd(n-1) with a data signal. Then, a $n^{th}$ block applying signal $\phi_n$ and a gate input signal GI are applied to transmit the data signal to a corresponding pixel. Accordingly, degradation of picture quality resulting from a charging time difference does not occur and vertical striping is eliminated because the charging time is regulated after the data signal is transmitted to the pixel.

Figure 6:
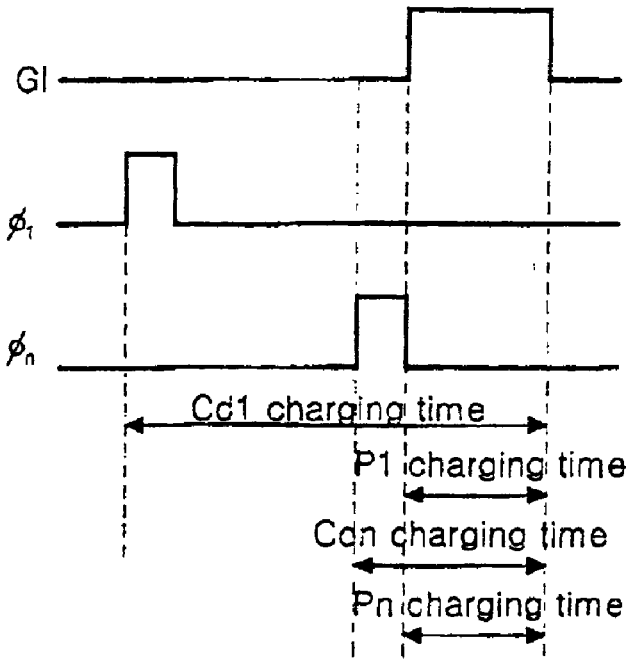
FIG. 6 is a signal waveform diagram according to another exemplary method of driving a liquid crystal display according to the invention.

However, degradation of the picture quality can occur because the data signal is first applied to the data line capacitors to charge the corresponding pixels in the $\phi_1$ to $\phi_{n-1}$ blocks, and then applied to the data line capacitor and the corresponding pixel in the $\phi_n$ block. Moreover, referring to Equation (1), when C2, i.e., capacitance of the pixel, is relatively large compared to the capacitance of the data line capacitors, a significant difference between V1 and V3 occurs. Accordingly, the charge sharing phenomenon is dependent upon the relative capacitances of the pixel and data line capacitors. To eliminate the degradation of the picture quality due to the charge sharing phenomenon, a driving method in which the charging sharing phenomenon occurs in all of the data line capacitors is implemented FIG. 6 illustrates another exemplary gate driving method according to the present invention. In FIG. 6, a data signal is applied from block applying signal $N_1$ to $N_n$, and a gate input signal GI is applied immediately after the $\phi_n$ block applying signal ends. Accordingly, the degradation of picture quality that occurs when there is a difference of charging voltages between data line capacitors and corresponding pixels, can be prevented.

Figure 7:
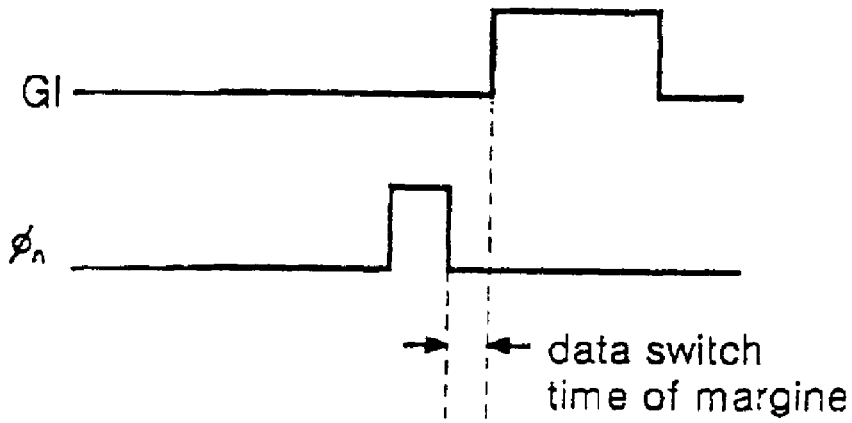
FIG. 7 is an exemplary signal waveform diagram according to a charge sharing phenomenon in the signal waveform diagram of FIG. 6.

FIG. 7 is an exemplary signal waveform diagram corresponding to a charge sharing phenomenon in the signal waveform diagram shown in FIG. 6. In FIG. 7, the pixel charging time is regulated by turning ON corresponding gates after application of the data signal to all the data line capacitors in FIG. 6. Then, in order to ensure that the charge sharing phenomenon occurs, a time margin is provided corresponding to an RC delay in the display panel at a turn-OFF time of the block applying signal $\phi_n$ and turn-ON time of the gate input signal GI.

Figure 8:
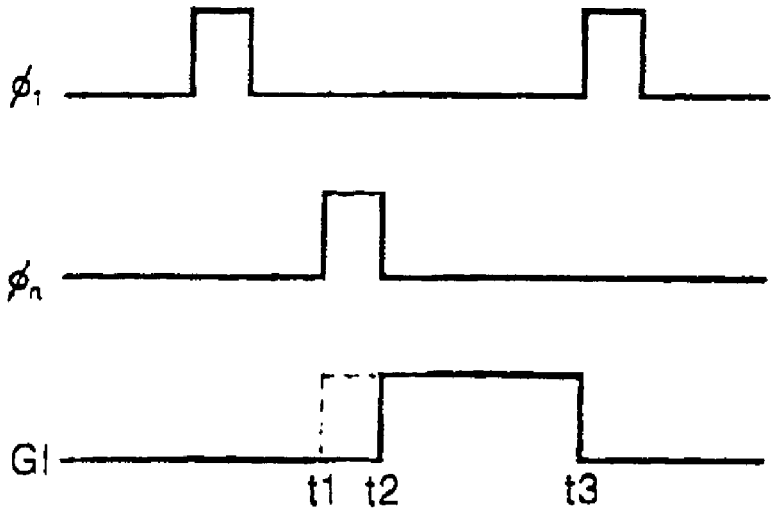
FIG. 8 is a signal waveform diagram in an exemplary method of driving a liquid crystal display according to the present invention.

FIG. 8 illustrates another exemplary gate driving method according to the present invention. In FIG. 8, a turn-ON time of a gate input signal GI is disposed between a point of a last block applying signal $\phi_n$ ending time t2, or a starting time t1 of charging a data line capacitor of a last block of a gate line and a starting time t3 of charging a data line capacitor of a first block of a next gate line.

Figure 9:
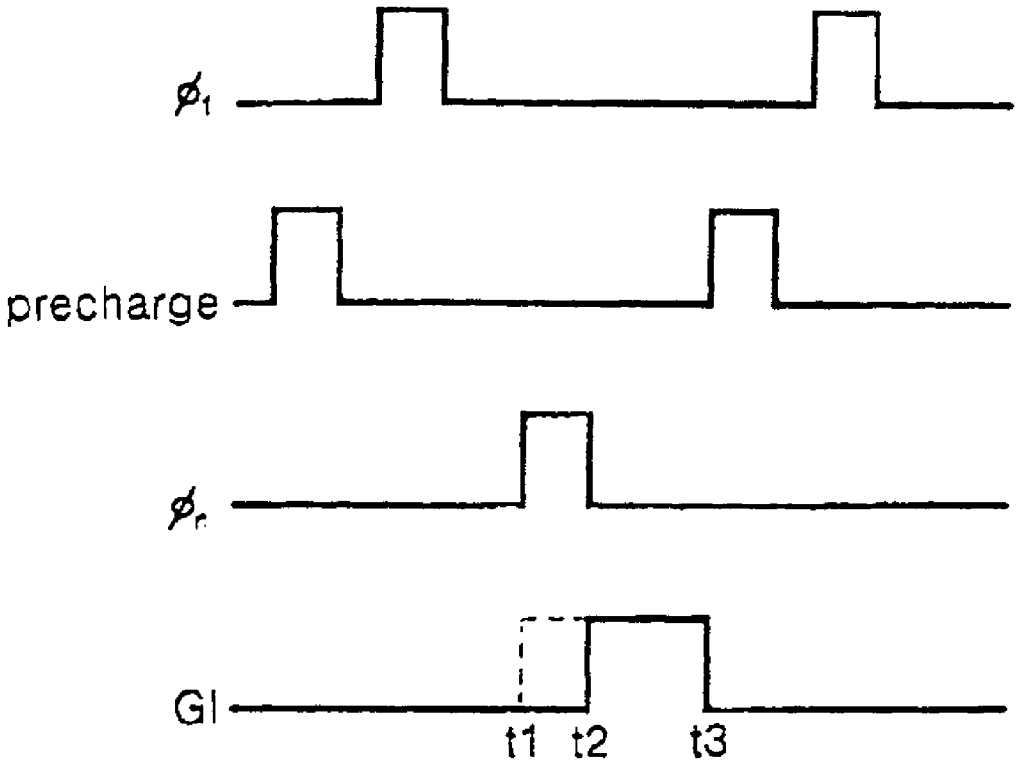
FIG. 9 is a signal waveform diagram in another exemplary method of driving a liquid crystal display according to the present invention.

FIG. 9 illustrates another exemplary gate driving method according to the present invention. In FIG. 9, a pre-charge signal is implemented to accept block applying signals $\phi_1$ to $\phi_n$ by a data line capacitor and a gate input signal GI. The pre-charge signal is applied before charging of the data line capacitor of the first block of the gate line. The pulse width of the pre-charge signal is equal to a pulse width of the signal applied to the data line capacitor. The gate charging time of the gate line is positioned between a point of a block applying signal ending time t2, or a starting time t1 of charging the data line capacitor of a last block of the current gate line to a point of starting time t3 of the pre-charging of a next gate line.

As previously mentioned, in a circuit and method of driving a liquid crystal display according to the present invention, upon block-driving of a polycrystalline panel, every gate is not made to be turned on during one horizontal period 1H. Every gate is made to be turned ON at a point of a start time, or an end time of writing data of a last block to a data line capacitor, in order to make an actual charging time of each pixel regular. Accordingly, a uniform screen can be realized because differences in pixel charge time is eradicated, thereby eliminating vertical striping during block-driving of a polycrystalline display panel.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display panel driving circuit, comprising:

a plurality of data signal lines;

a plurality of data lines;

a plurality of data switches, each data switch connecting at least one data signal line to the plurality of data lines;

a plurality of pixels;

a plurality of pixel switches connecting a data signal transmitted on each data line to at least one of the pixels; and a plurality of capacitors, each capacitor connected to at least one of the data lines for storing a voltage corresponding to the data signal transmitted by one of the data switches and for transmitting the voltage to one of the pixels, wherein each of the plurality of capacitors simultaneously transmit the voltage to the pixels.

2. A method for driving a liquid crystal display, comprising the steps of:

sequentially switching a plurality of signal transmission paths between a plurality of signal and data lines to sequentially charge voltages corresponding to a data signal to a plurality of data line capacitors; and simultaneously transmitting each voltage of each data line capacitor to a pixel through at least one of the data lines.

3. The method according to claim 2, further including the step of enabling an input gate after sequentially enabling a plurality of data switches from a first to an $n^{th}$ block to apply the charged voltages to each data line capacitor.

4. The method according to claim 3, wherein a first time period is provided between a time when the data switch of the $n^{th}$ block is disabled and a time when the input gate is enabled.

5. The method according to claim 3, wherein a first time period to enable the input gate is provided between an ending time when the $n^{th}$ block of a first gate line is enabled and a starting time of charging the data line capacitor of the data line of the first block of a second gate line.

6. The method according to claim 5, wherein a pre-charge signal is applied between the ending time of charging the data line capacitor of the $n^{th}$ block of the first gate line and the starting time of charging the data line capacitor of the data line of the first block of the second gate line.

7. The method according to claim 6, wherein a time to enable the input gate of the first gate line is between the starting time of charging the data line capacitor of the $n^{th}$ block of the first gate line and the starting time of the pre-charge signal of the second gate line.

8. The method according to claim 6, wherein a time to enable the input gate of the first gate line is between the starting time of charging the data line capacitor of the $n^{th}$ block of the first gate line and the starting time of the pre-charge signal of the second gate line.

9. The method according to claim 3, wherein a first time period to enable the input gate is provided between a starting time of charging the data line capacitor of the $n^{th}$ block of a first gate line and a starting time of charging the data line capacitor of the data line of the first block of a second gate line.

10. The method according to claim 9, wherein a pre-charge signal is applied between the ending time of charging the data line capacitor of the $n^{th}$ block of the first gate line and the starting time of charging the data line capacitor of the data line of the first block of the second gate line.

11. The method according to claim 10, wherein a time to enable the input gate of the first gate line is between the ending time of charging the data line capacitor of the $n^{th}$ block of the first gate line and the starting time of the pre-charge signal of the second gate line.

12. The method according to claim 10, wherein a time to enable the input gate of the first gate line is between the starting time of charging the data line capacitor of the $n^{th}$ block of the first gate line and the starting time of the pre-charge signal of the second gate line.

* * * * *